US007377081B2

(12) United States Patent
Ruhdorfer

(10) Patent No.: US 7,377,081 B2
(45) Date of Patent: May 27, 2008

(54) ARRANGEMENT OF BUILDING ELEMENTS WITH CONNECTING MEANS

(75) Inventor: Herbert Ruhdorfer, Salzburg (AT)

(73) Assignee: Kaindl Flooring GmbH (AT)

( * ) Notice: Subject to any disclaimer, the term of this patent is extended or adjusted under 35 U.S.C. 154(b) by 0 days.

(21) Appl. No.: 10/446,456

(22) Filed: May 28, 2003

(65) Prior Publication Data

US 2004/0016197 A1 Jan. 29, 2004

(30) Foreign Application Priority Data

Jul. 24, 2002 (DE) ..... 102 33 731

(51) Int. Cl.
*E04B 2/00* (2006.01)
*E04B 2/32* (2006.01)

(52) U.S. Cl. ..... 52/588.1; 52/592.1

(58) Field of Classification Search ..... 52/578, 52/582.1, 586.1, 586.2, 592.1, 588.1; 403/286, 403/292, 294, 295, 300, 265, 268, 270, 272
See application file for complete search history.

(56) References Cited

U.S. PATENT DOCUMENTS

| | | | | |
|---|---|---|---|---|
| 1,743,492 | A * | 1/1930 | Sipe | 403/297 |
| 2,023,066 | A * | 12/1935 | Curtis et al. | 52/578 |
| 3,760,548 | A * | 9/1973 | Sauer et al. | 52/592.1 |
| 5,348,778 | A * | 9/1994 | Knipp et al. | 428/35.8 |
| 5,548,937 | A * | 8/1996 | Shimonohara | 52/586.1 |
| 5,694,730 | A * | 12/1997 | Del Rincon et al. | 52/586.1 |
| 5,911,662 | A * | 6/1999 | Hallsten | 52/246 |
| 6,065,262 | A * | 5/2000 | Motta | 52/582.1 |
| 6,101,778 | A * | 8/2000 | Mårtensson | 52/582.1 |
| 6,397,547 | B1 * | 6/2002 | Mårtensson | 52/582.1 |
| 6,397,548 | B1 * | 6/2002 | Martin et al. | 52/592.4 |
| 6,421,970 | B1 * | 7/2002 | Martensson et al. | 52/282.1 |
| 6,438,919 | B1 * | 8/2002 | Knauseder | 52/586.2 |
| 6,446,413 | B1 * | 9/2002 | Gruber | 52/747.11 |
| 6,526,719 | B2 * | 3/2003 | Pletzer et al. | 52/592.2 |
| 6,617,009 | B1 * | 9/2003 | Chen et al. | 428/148 |
| 6,865,855 | B2 * | 3/2005 | Knauseder | 52/592.1 |
| 6,866,923 | B2 * | 3/2005 | Thornsberry | 428/304.4 |
| 6,955,020 | B2 * | 10/2005 | Moriau | 52/592.2 |
| 2002/0108323 | A1 * | 8/2002 | Gruber | 52/177 |
| 2002/0148551 | A1 * | 10/2002 | Knauseder | 156/182 |
| 2004/0221537 | A1 * | 11/2004 | Martensson | 52/578 |
| 2005/0108969 | A1 * | 5/2005 | Whitaker | 52/578 |

FOREIGN PATENT DOCUMENTS

| | | | |
|---|---|---|---|
| DE | 20119830 U1 * | 6/2002 | |
| JP | 05018028 A * | 1/1993 | |
| WO | WO 02/081843 A1 * | 10/2002 | |
| WO | WO 02/103135 A1 * | 12/2002 | |

* cited by examiner

*Primary Examiner*—Robert Canfield
*Assistant Examiner*—Ryan D Kwiecinski
(74) *Attorney, Agent, or Firm*—The Webb Law Firm

(57) ABSTRACT

An arrangement of building elements capable of a snap-fastening interconnection comprises an element, especially the tongue, consisting of a different material from the other building elements. An MDF/HDF panel, is initially milled along the longitudinal and/or transverse sides, and the resulting groove is then provided and/or foam-filled with extrudates. Finally, the free ends of the extrudates are milled to form the profile of the tongue. Alternatively, or additionally, a groove may also be milled into the extrudates.

49 Claims, 3 Drawing Sheets

FIG.6
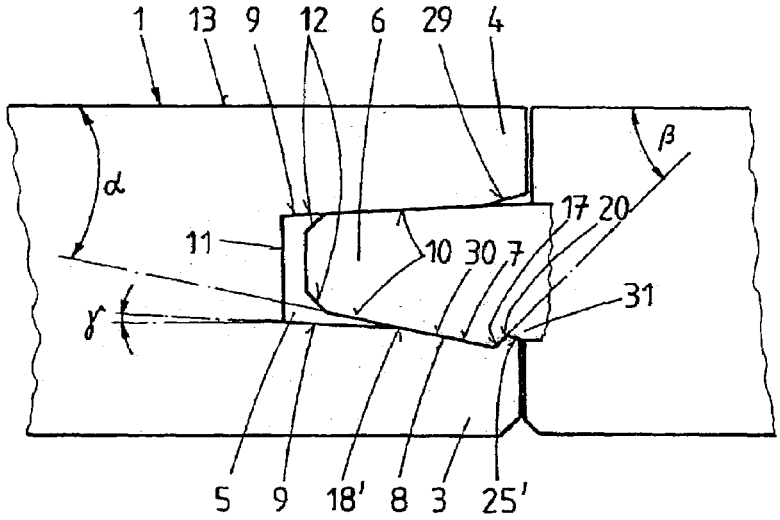
FIG.7
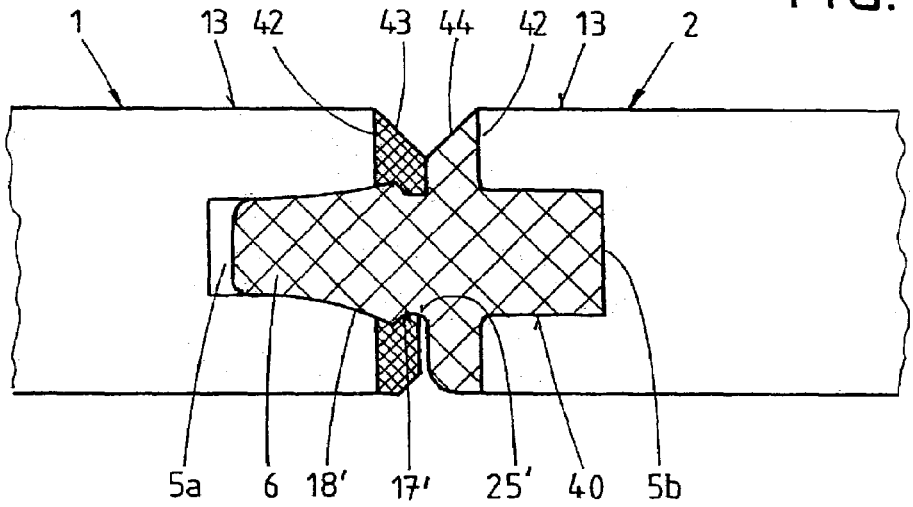
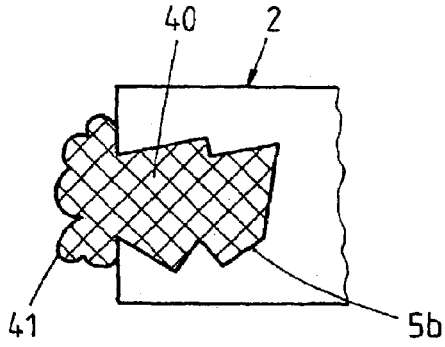
FIG.8

ARRANGEMENT OF BUILDING ELEMENTS WITH CONNECTING MEANS

BACKGROUND OF THE INVENTION

The invention discloses an arrangement of building elements with connecting means, especially panels capable of separable connection to one another.

In this context, building elements are understood to mean panel-shaped building elements such as panel boards, floor boards, cladding boards, cladding strips especially for covering walls, ceilings or floors in buildings of every type. Building elements of this kind may comprise single or multiple-layer panels and/or strips made from wooden materials or on a wooden base (laminate), especially chipboard, medium density fibre board (MDF), high density fibre board (HDF), oriented strand board (OSB) and plywood panels, which may optionally be coated on one or both of the exterior surfaces. The coating or so-called useful surface maybe produced with synthetic material sheets, solid wood, veneers made from wood or synthetic material or paper etc. In the case of flooring panels, a decorative paper, for example with a natural wood design, intended to create the impression of a solid wooden panel, is widely known. Since flooring is placed under considerable stresses during normal use, the surface of the decorative paper is sealed with a hard, especially scratch-resistant and abrasion-resistant, overlay made, for example, from resin-soaked alpha-cellulose paper, and is therefore protected from scratches and dents. In particular, therefore, the invention relates to flooring boards or so-called panels, which consist of wooden materials and provide a relatively hard surface made from synthetic-material laminates.

Arrangements of building elements with separable connecting means are known from the prior art. The invention discloses a special type of design and manufacture for building elements and connecting means, which keeps the building elements in the optimum position relative to one another in the connected condition, but also allows the building elements to be separated from one another if required.

Known arrangements of building elements in the form of flooring panels provide at their lateral edges tongues and/or grooves, especially tongues which can snap into the grooves. Panels of this kind can be manufactured in a particularly economical manner, because only the generally relatively soft middle layer of the panels consisting particularly of wood needs to be processed specially in order to form the tongues and grooves acting as the locking means. The middle layer can also be described as the carrier layer or core. In the case of laminate flooring with a tongue milled into the middle layer, the middle layer generally consists of chipboard, MDF, HDF, hard-fibre board, solid wood or plywood material. These materials provide the disadvantage that, as described above, the tongues, in particular, are relatively soft and can therefore break either in their entirety or in part. A panel with a partially crushed tongue can only be introduced into the groove of another panel if the crush damage is specially treated prior to laying. This requires additional work when laying, and the strength of the connection between the interconnected panels is reduced.

The tongue which projects beyond at least one lateral edge of the panel is particularly susceptible to damage, because it can strike obstacles particularly hard in view of its small cross-section and the relatively heavy weight of the panel. This problem is encountered in manufacture and transportation as well as laying. The groove is also susceptible, because in the region of the groove, the panel provides a reduced wall thickness and strength. The exterior walls of the groove may even be thinner than the cross-section of the tongue.

Damaged tongues or tongues made from material permeable to water or capable of absorbing water also render the tongue and groove connection itself more permeable to water. Water spilled on the area of the connection can therefore penetrate more readily into the generally liquid-absorbing internal material layer (core) of the panel, which therefore swells and becomes visually unattractive. The moisture can also penetrate through the tongue and groove connection settling under the panels for a considerable time. This moisture cannot be observed or removed and, in the long-term, can therefore lead to consequential damage typical of moisture, especially mould, bacteria, efflorescence and staining.

EP 1 024 234 discloses panels of this kind with tongue and groove connections, wherein locking means for a snap-fastening are provided on the tongues and grooves. Since the tongues and grooves are milled from the core, which consists of HDF or MDF, in one piece with the locking means, the strength properties of the tongues and grooves are determined by the material properties of the core of the panel. In view of the strength of the connecting and locking means required for a secure connection, the core of the panel must therefore be harder, stronger, heavier and more expensive than is necessary, for example, for a floor covering.

U.S. Pat. No. 5,295,341 discloses panels in which the fastening means are connected to the edges of the panels in the form of strips, so that the materials used for the panels and the connecting means can each be optimised. In order to connect the connecting means to the panels, hook-shaped anchors are formed on the connecting strips, which engage with undercutting provided on the panels. An undercut geometry of this kind can only be manufactured at a considerable expense.

WO-A-00/20706 and WO-A-00/20705 disclose flooring panels which can be connected to one another via separate connecting profiles by moving the longitudinal edges horizontally towards one another or by lowering the longitudinal edges vertically. Accordingly, the locking means must lock on both sides, that is, with the longitudinal edges of two profiles to be connected. This increases manufacturing costs, because the separate connecting means must be attached to the longitudinal side of a profile in the factory. Otherwise, the work required on-site by the installer is increased, because, immediately before installation, the installer has to connect the connecting means first to one side and then to the other side of the panel to be connected. Accordingly, the connecting means are not firmly connected to the panel on both sides, thereby doubling the risk of accidental separation and rendering the connection less rigid and less strong. Moreover, additional processing stages must be carried out for each connection, namely, for two grooves and two tongues. Normally one groove and one tongue is sufficient for each connection.

The object of the present invention is therefore to provide an improved arrangement for building elements with connecting means, which removes the disadvantages named above.

SUMMARY OF THE INVENTION

This object is achieved with an arrangement of building elements according to this invention.

The invention creates an arrangement of building elements capable of interconnection using connecting means, in particular, snap-fastening connecting means.

Optimum materials with reference to properties and costs can be selected independently from one another both for the building elements and the connecting means, especially the tongues, because at least one of the two connecting means, especially tongue, consists of a different material from the building element to which the connecting means, especially tongue, is inseparably connected. Manufacturing costs can been reduced because only one tongue and one groove need to be manufactured to provide the separable connection.

In order to manufacture a non-glued connection between flooring elements and other building elements according to the prior art, the corresponding carrier materials, that is to say, the building elements, had to provide good mechanical strength, because hitherto, the corresponding form-fit or force-fit connections were also made from the carrier materials. Known panels are formed in one piece with the tongue and/or groove, whereas the invention presents a two-piece design. Accordingly, it is now possible to manufacture the middle layer of the panels in a particularly cost-favourable manner or with a very light weight-to-area ratio, for example, by using the materials named above. The connecting means comprising tongues and/or grooves can, however, be manufactured from strong and heavy materials, because the overall weight of the arrangement of panels is only slightly influenced. The connecting means may, for example, consist of PVC, synthetic materials and similar, which are harder than the core of the panels and can be manufactured using a special milling machine (e.g. pencil milling cutter). As a result, this particularly heavy and/or stable material is only processed where it is actually needed, while the core of the panel consists of lighter and more cost-favourable material. The weight of the panels is a substantial economic factor, because it influences transport costs, the price of the products and acceptance by the consumer. Accordingly, a high potential for savings is achieved if only the form-fit or force-fit component is provided with high mechanical strength.

If at least one of the connecting means is inseparably connected to the building element to which it is allocated, for example, in the form of a tongue or groove consisting of a different material from the corresponding building element, errors in assembly can be avoided. The connecting means cannot, for example, slip or be displaced along the longitudinal side, and liquid spilled onto the joint between two building elements is prevented from penetrating any further into the building element or from entering under the building element where it may cause further damage.

An inseparable connection of this kind can be achieved, in particular, with a form-fit connection. A connection of this kind is particularly economical to manufacture and very strong, if the connecting means are brought into contact with the relevant building element in a liquid or soft condition. The liquid connecting means penetrates into openings and pores (see P in FIG. 4) in the building element thereby providing a form-fit connection. A comparable strength cannot be achieved by gluing.

A form-fit connection is particularly effective if the still liquid or soft connecting means is introduced into groove with or without undercutting of the building element, in particular, along the end face or longitudinal side of a panel-shaped building element. Grooves without undercutting can be produced very simply and rapidly, for example, working from the end face, along the entire length of the end-face. Undercut grooves are more expensive to manufacture but hold the connecting means introduced more firmly in place.

The interior contour of the grooves may also be formed as desired, for example, by milling, crushing or other less accurate processes. This renders the process simpler, more cost-favourable and faster, and the strength of seating is improved. Accurate processing tools are not required in this context.

If the grooves provided for the inseparable connection of the connecting means, provide arms of unequal length, that is to say, if they are designed in a projecting manner, the building elements can be assembled more readily. The arm projecting at the lower side of the building element can be used as a guide when moving the building elements together.

If the grooves provided for the inseparable connection of the connecting means, provide arms of unequal length, that is to say, if they are designed in a projecting manner, a higher loading capacity of the connecting means will be provided in the direction of the projecting arm. A projecting arm of this kind at the underside of the building element can, for example, absorb the forces resulting from walking over the building element.

This can be achieved in a particularly economical manner if the connecting means is manufactured from extrudate, wherein this extrudate can be brought into contact with the building element after leaving the extruder while still in a soft condition, in order to form a connection with the building element.

Extrudates are generally formed parts, manufactured by means of an extruder. While formed parts of this kind normally initially harden into the final shape, before they are connected to other building elements, it is advantageous to connect these formed parts to the building elements while they are still in a soft and or liquid condition. In this context, it is not necessary for the extruder to provide a specific profile. On the contrary, it is merely important that the liquid and/or soft extrudate is introduced into the groove of the building element which it fills thereby creating a connection with the building element. If the end face, that is to say, the longitudinal or transverse side of the building element in which the groove has been formed, is disposed in a horizontal orientation, the extrudate can flow downwards into the groove, whereby a surplus of material will accumulates on the end face, without adopting a precisely defined profile. Providing a precisely defined profile is the object of the subsequent processing stage. Accordingly, in the sense of the invention, any device from which a still not completely hardened material can be expelled in a controlled manner may be used as the extruder; there is no need for the extruder to give the material a defined form. However, it is advantageous if the form is adapted to the final form so that less material needs to be removed in final processing.

In the sense of the invention, a connection is separable if, on the one hand, this connection is sufficiently strong so that it cannot be accidentally separated, but on the other hand, it can be separated again without destruction if required. In the context of flooring panels, this means that during use, that is to say, when walking on the floor and moving loads across the floor, the laid and connected flooring panels cannot accidentally be separated from one another. However, if required, for example, in the case of a laying error, repair or disassembly, the connection should be readily separable, for example, by pulling apart or separating two building elements from one another within the plane which they occupy. By way of additional explanation or as an alternative, a separable connection may also be understood to mean a connection which can be released again, if required, by tilting or twisting the individual building elements.

A particularly strong and cost-favourable connection can be achieved if the connecting means is capable of foaming and can therefore completely fill the groove in the building element intended for filling (filling groove), thereby enlarging the contact surface between the connecting means and the filling groove.

The extrudate is therefore introduced into the filling groove in the same operational process as the manufacture of the flooring, thereby achieving cost-savings.

The connecting means inseparably connected to the building element provides the further advantage that during final processing, for example, during the milling out of the tongue or groove, the connecting means cannot slip and is already located in its final position. As a result, the tongue or groove is formed more accurately and provides a better fit. Accordingly, the building elements can be connected to one another more simply, more strongly and more securely. This cannot be achieved when using ready-formed tongues which are subsequently fixed to the building elements.

A snap-fastening is provided when a form-fit connection is produced with resilient building elements which give during the connecting process, e.g. by spreading the arms of the groove, or compressing the tongue. So-called snap-fastening connections can be easily and securely implemented by the installer and are also very accurate.

Provided the maximum thickness of the connecting means is less than the thickness of the panels, the connecting means will not be perceived and cannot therefore impair the visual effect. The connecting means can be produced in a material-saving manner if its maximum thickness is equal to the maximum thickness of the tongues.

If the end faces of two adjacent panels are butted together in the region of the upper surface, for example, the decorative or overlay surface, dirt and moisture cannot penetrate into the core of the panels.

The flat under-surface of the panels has a positive visual effect; it is simpler to manufacture than a contoured underside and also provides footfall damping because it avoids hollow cavities.

Coated upper and lower sides also make the surface less sensitive to scratching, dents and moisture as well as ensuring an attractive visual effect.

Tongues and grooves with snap-fastening locking elements in the form of recesses or indentations, extending along the entire length of the groove and tongue, allow very simple and economical manufacture. The connecting means formed in this manner can be connected and/or separated rapidly and reliably in a material-saving manner at the same time as ensuring that the panels are held in place relative to one another in an optimum manner in the connected condition.

If the locking means are glued or connected to the panels in the factory, no changes are required in the laying of panels by comparison with the laying of known tongue and groove panels. Joining together building elements designed according to the invention, achieves a strong and stable but still separable connection, which is appropriate for the stresses arising and which connects the building elements to one another in a stable position.

The groove is advantageously worked, especially milled directly into the building element, thereby simplifying the manufacture of panels of this kind. This applies especially for building elements which provide groove arms of the same length and can therefore be manufactured in a single operation with a symmetrical milling head. Apart from slight differences in length, resulting from the fact that the building elements may be disposed close to one another in the region close to the surface, but may be arranged at a distance from one another in the region close to the floor thereby providing a small gap, the two arms of the groove are essentially of the same length. This ensures that the two upper sides of panels can be securely butted together even in the presence of certain irregularities in the surface of the under-floor.

As with conventional floor panels, the installer must then simply push the two elements together; there is no perceptible difference in the product. The installer benefits only from the improved material properties of the connecting means, of which only the tongue projecting beyond the panels and the interior of the groove is visible. Panels manufactured in this manner can also be combined with existing panels with a one-piece tongue and groove milled out of the core; however, a certain downward compatibility of the product according to the invention would apply with reference to known products. As a result, further areas of application are opened up and the system can be used in the more flexible manner.

The width of the groove, which increases from the inside to the outside and/or the thickness of the tongue, which reduces towards its free end, are matched with one another, so that when the building elements are connected to one another, the surfaces of the groove and tongues are in close contact with one another and create a form-fit connection. Accordingly, the building elements are held in place in a mutually defined position.

The fact that the surface close to the building element of the projection formed on the tongue, and the surface close to the groove opening of the indentation in the groove provide an oblique and/or inclined course towards the building element and the groove opening respectively, so that the tongue can be withdrawn from the groove, makes a substantial contribution to the formation of a separable connection. Insertion and withdrawal is possible because at least one of the arms of the groove is capable of being widened or moved apart in a resilient manner relative to the other arm; in particular, both arms of the groove are designed with reference to material thickness and strength in such a manner that a resilient bending outwards is possible thereby allowing the tongue to be inserted into the groove; the at least one projection formed on the tongue can overcome the internal edges at the groove opening, precisely because the projection slides over the internal edges thereby pressing apart the arms of the groove.

The locking elements for connecting the building elements in a stable position, which are formed from mutually matching projections and indentations, are provided on the tongue and on the groove. These locking elements can be provided in separate portions along the tongue and the groove; however, better holding and simpler manufacture are achieved if the locking elements extend over the entire length of the tongues and grooves.

One embodiment of the arrangement according to the invention, in which corresponding projections are provided on both sides of the tongue and corresponding indentations are formed on both surfaces of the groove is particularly advantageous, because this achieves a double snap-fastening effect thereby ensuring a strong connection between the building elements.

The width of the building elements can be selected as desired. Building elements of the same width or of a different width can be connected to one another, for example, in order to achieve a given floor design.

The building elements can be pushed together and/or separated advantageously wherein the connecting means provides greater strength than the material of the building element.

One preferred embodiment of the invention is characterised that the cross-sectional form of a tongue with at least one projection disposed upon it and at least one correspondingly matching indentation in the groove allows good sliding between the surfaces of the tongue and/or the projection provided on the tongue along the groove surfaces and/or the groove surfaces directly adjacent to the groove opening when the tongue is inserted into the groove.

A strong snap-fastening between the two building elements to be connected is provided where especially, in order to achieve a strong but separable connection of the building elements, the groove is formed directly in the building element itself and/or is worked into the building element, the width of the groove increases from the inside to the outside, the thickness of the tongue decreases towards its free end, the projection on the tongue provides a front surface enclosing an angle $\alpha$ relative to the surface of the building elements and a shorter rear surface adjoining the latter surface and enclosing an angle $\beta$, which exceeds the angle $\alpha$ relative to the surface of the building elements thereby forming a kink, the indentation in the groove provides a contact surface close to the base of the groove, which, in the locked position, is at least partially in contact with the longer front surface, and a shorter, contact surface, remote from the base of the groove, which, in the locked position, is in contact with the shorter, rear surface of the projection, and, at least one of the two, but preferably both, of the arms of the groove can be bent outwards in a resilient manner relative to the other arm of the groove in each case, so that the tongue is held in the resting position by the arms of the groove subject to the clamping effect and/or can be inserted into and/or withdrawn from the groove subject to the resilient deformation of the arms of the groove.

The tongue of one building element can be inserted into and released from the groove of the other building element in a particularly advantageous manner where the angle $\alpha$ enclosed by the front surface relative to the upper surface of the building elements is greater than the angle $\gamma$ enclosed by the region of the groove surface close to the base of the groove relative to the upper surface of the building elements. In this context, the release or separation of the tongue from the groove is indeed associated with an increased resistance by comparison with the resistance encountered when the tongue is inserted into the groove; however, the tongue is held firmly in the groove, while the separation of this snap-fastening connection is still readily possible.

The formation of an elastic, resilient tongue, e.g. a slotted tongue or slotted portions of the tongue, is not necessary, because the arms of the groove are sufficiently resilient to widen accordingly when the tongue is inserted. A solid tongue can therefore be manufactured more readily where in forming the projection only on one side of the tongue and the indentation only on the side of the groove facing towards the latter side, the surfaces of the tongue and groove without projections or indentations are in tight and close contact with one another and enclose the same angle $\gamma$ relative to the upper surface of the building elements.

The tongue and groove are simple to manufacture and allow good mutual positioning of the tongue and groove where the tongue surfaces close to the end region of the tongue provide the same angle of inclination relative to the surface of the building elements, as the regions of the groove surfaces close to the base of the groove, with which regions of the tongue surface close to the end of the tongue are in contact in the connected condition of the building elements, an indentation or recess with a triangular form in the cross-section perpendicular to the direction in which the building elements are joined, is provided as a locking element along the course of at least one groove surface, preferably the groove surface close to the upper surface, and especially along both groove surfaces, a projection with a triangular form in the cross-section perpendicular to the direction in which the building elements are joined is provided along the course of at least one tongue surface, preferably the tongue surface close to the upper surface, and especially along both tongue surfaces, and in the connected condition of the building elements, the projection and the indentation are in contact with one another along their contours in a tight, close and play-free manner.

The insertion of the tongue into the groove is simplified where in the locked condition of the building elements, substantially the entire region of the tongue surface disposed in front of the projection towards the front end of the tongue is in contact with the groove surface.

The position of the tongue in the groove, because the projection is disposed exactly in the indentation and accordingly, the projection and the indentation and/or the surfaces of the tongue and the surfaces of the groove are in accurate and close contact with one another.

The formation of the cross-section of the triangular projection and/or of the projection on the tongue accommodated in the indentation in the groove simplifies the insertion of the tongue into the groove and/or holds the tongue securely in the groove while still allowing the tongue to be withdrawn from the groove without material damage.

The insertion of the tongue into the groove avoids jamming and ensures that the surfaces of the building elements to be connected are in close contact with one another at the end faces and/or are brought closely together by the snap-fastening of the projections on the tongue in the indentations of the groove where the surface region of the groove surface between the groove opening and the beginning of the shorter side of the triangle of the indentation encloses an angle relative to the surface of the building elements which corresponds to the angle of inclination of the longer side of the triangle, wherein this surface region of the groove is designed as a sliding surface for the longer side of the triangle of the protection provided on the tongue.

It has been shown in practice that where the region close to the free end of the tongue and also the region of the tongue surface close to the end face of the building elements continues in each case into the longer and shorter side of the triangle of the projection, in each case forming a kink, the groove widens smoothly when pushing the building elements together; the panels are automatically fixed by the snap-fastening; and a very firm, play-free seating of the connection is provided in the closed condition. Furthermore, the manufacture of the tongues and grooves is simplified, and forces are transferred in the material-saving manner.

With reference to floor-laying technology, where the side of the triangle close to the base of the groove or the portion of the tongue surface accommodated in the indentation is approximately four-times to eight-times, preferably five-times to seven-times as long as the side of the triangle remote from the base of the groove or the shorter, rear surface, and that the angle between the two sides of the triangle or between the portion of the tongue surface and the shorter rear surface is 100° to 140°, particularly, 110° to 130°, or the longer side of the triangle and the shorter side of the triangle of the projection or of the indentation continue into the front and/or rear region of the groove surface and tongue surface respectively, thereby forming a kink and at the same time a simple, visually attractive result is ensured. In this context, relatively wide, panel-shaped building elements, which need not necessarily be elongated, but may, for example, also be rectangular or square, are held together with the assistance of narrow, strip-like building elements, thereby providing an attractive pattern as well as a simple laying technique.

Further advantageous embodiments of the invention are described below with reference to the diagrams and claims.

By preference, the following procedure is used for the manufacture of the arrangement of building elements according to the invention. Initially, the building element, especially an MDF/HDF panel is milled along the longitudinal and/or transverse sides and then the resulting groove is provided and/or foam-filled with extrudate. Following this, the free ends of the extrudate are milled off to form the profile of the tongue. Alternatively, however, a groove may also be milled into of the extrudate.

A rapid-hardening extrudate may also be profiled during the extrusion process thereby saving time, materials and costs. The profiling can be carried out, for example, by forming or by cutting. A corresponding one-piece procedure can therefore be realised alongside the one-piece operation already described.

The use of a synthetic material as the extrudate is preferred because this can be milled most accurately.

Amongst other factors, the advantage of the invention by comparison with the prior art is that the extrudate can be introduced in the same operational procedure as the manufacture of the building element; the profiles are very firmly bonded to the core material; when synthetic material is used, the profiles can be milled much more precisely and can therefore be milled to achieve better locking; the extrudate represents a cost-favourable material; the tongues or grooves can be provided with resilient properties independently from the material properties of the core material; and the connecting surfaces do not need to be sealed, because the absorption of water and moisture is reduced and/or prevented by the extrudate and/or the synthetic material.

Potential savings can be achieved with reference to material and transport if the milled material, that is, the material which has been removed from the panel during the milling of the grooves, is mixed with other components and subsequently injected back into the grooves in order to mill the tongue and/or the groove into this material to form a sharp edge. Accordingly, this wooden material need not be procured or transported. Storage and disposal of milling waste are not required.

Furthermore, according to the invention, the extrudate may extend up to the surface of one or both building elements. In this context, it provides an intermediate component, mechanically and visually, along the edges of the building elements. It therefore fulfils a double function, acting as a connecting means and at the same time fulfilling aesthetic, protective and stabilising functions; in the sense of the invention, it is not compulsory for the extrudate to serve as a connecting means.

If the extrudate forms the end face of the building elements, this edge can be processed more accurately, thereby achieving a more precise fit. This prevents the accidental separation of the connection and the penetration of contamination into the connection. Furthermore, the connection itself is less visible. The edges of the wooden materials very frequently become splintered i.e. provided with raised fractures in the region of the surface in danger of impact. Splintering also occurs when processing the edges. Especially after the panels have been laid, such splinters are very readily visible along the edges if viewed against back lighting. When the extrudate according to the invention extends up to the surface, it can prevent or conceal these edges.

If the extrudate is water-resistant, it will protect the building element, which is generally moisture-absorbing, thereby preventing the absorption of water. Moisture is known to cause swelling, leading to an unattractive appearance of the building element. Impregnating the edges of the building element, which would normally be carried out for this reason, is therefore no longer required.

The extrudate acting as an intermediate component can be produced in various materials, structures and colours. Especially when they are coloured, intermediate components of this kind, provide a decorative feature creating visual effects ranging from the sophisticated to the rustic.

As a component of the tongues and grooves, the extruded intermediate components may also be milled as desired. Accordingly, the edges of the building elements can be profiled as required. For example, indentations and/or raised portions is can be milled into the connections. Such indentations and/or raised portions can be used to conceal differences in height between the individual surfaces of the building elements and/or raised splinters. For instance, a V-shaped connection manufactured in the above manner creates a particularly rustic look. By contrast, metallic intermediate components provide a sophisticated look, giving the impression of expensively framed wooden boards. Because the extrudate is first connected to the building element and only then is the extrudate processed, the accuracy of fit and strength of the connection are both increased, and water cannot penetrate into the building element because of the excellent edge seal.

BRIEF DESCRIPTION OF THE DRAWINGS

The invention will be explained below in great detail with reference to the diagrams:

FIG. 6 shows the profile of the tongue in an asymmetrical design;

FIG. 7 shows two building elements connected to one another according to the invention in a second embodiment;

FIG. 8 shows an MDF/HDF board in the region of a longitudinal or transverse side in cross-section after application of the extrudate according to another embodiment of the groove.

DETAILED DESCRIPTION OF THE PREFERRED EMBODIMENTS

Figure 1:
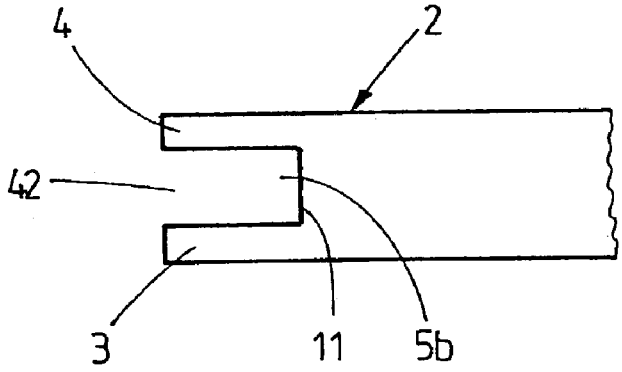
FIG. 1 shows an MDF/HDF board in the region of the longitudinal or transverse side in cross-section before the application of the extrudate.

FIG. 1 shows a cross-section of the left-side, free end of an MDF/HDF panel in the region of a longitudinal or transverse side. The left, end face 42 of the panel 2 provides a groove 5*b* manufactured, for example, by milling. The interior surfaces of the groove 5*b* are therefore formed by the two equally long arms 3 and 4, and by the base of the groove 11.

Figure 2:
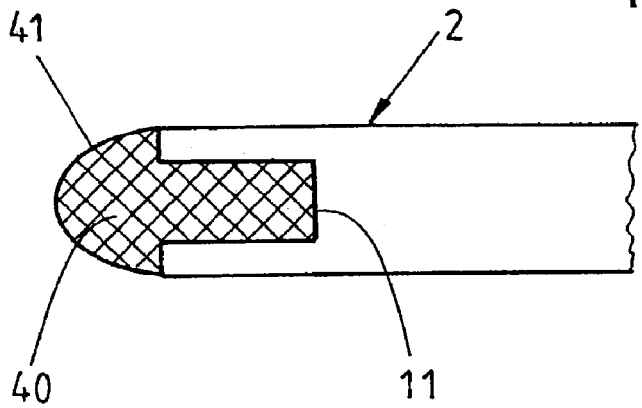
FIG. 2 shows the board from FIG. 1 after application of the extrudate.

FIG. 2 shows the panel from FIG. 1 after the extrudate 40 has been introduced into the groove 5*b*. The extrudate 40 was introduced into the groove in a liquid and/or soft condition and fills the groove completely, that is, down to the base of groove 11. The extrudate is firmly connected to the panel via the arms 3,4 and the base of groove, because the extrudate has penetrated into the pores of the panel and/or has filled any irregularities in the interior of groove. The extrudate may also provide the property of foaming. If the extrudate is readily pourable, it should be poured from above into the groove 5*b* when the groove is in a vertical orientation. This corresponds to FIG. 3 after rotation through 90° in a clockwise direction. An excess of extrudate remains on the end face 42 providing a protuberance 41.

Figure 3:
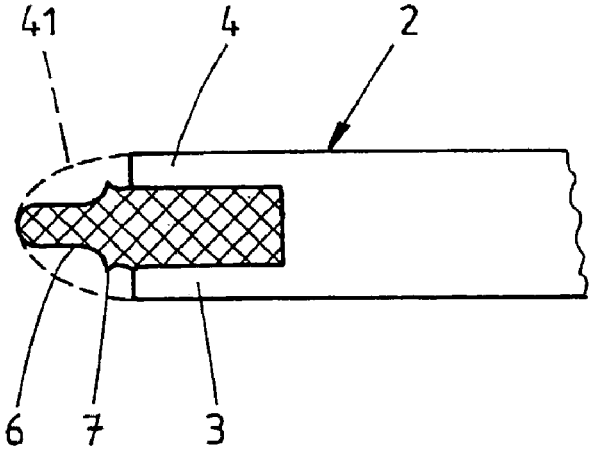
FIG. 3 shows the board from FIG. 2 after the processing of the extrudate connected to the board.

In FIG. 3, a tongue 6, which, for example, comprises the locking means 7 for connecting to a correspondingly formed groove 5*a* (not shown), has been formed by an appropriate process such as milling, from the excess of extrudate 40 providing the protuberance 41.

The procedure shown in FIGS. 1 to 3 for forming a tongue is merely exemplary. With the same operational stages, it is possible to introduce the extrudate into the groove 5*b* and subsequently to form an internal groove in this extrudate for connection with the tongue. The following possibilities are therefore provided by the invention: forming only the tongue from an external material; forming only the groove from an external material; and forming the tongue and the groove from the external material.

By way of additional information, FIG. 8 shows that the internal contour of groove 5*b* can also be formed as desired, for example, by milling, crushing or other less accurate processes than milling. The filling 40 then contacts the interior contour of the groove 5*b* in a very positive manner, which increases the strength of the connection.

Figure 4:
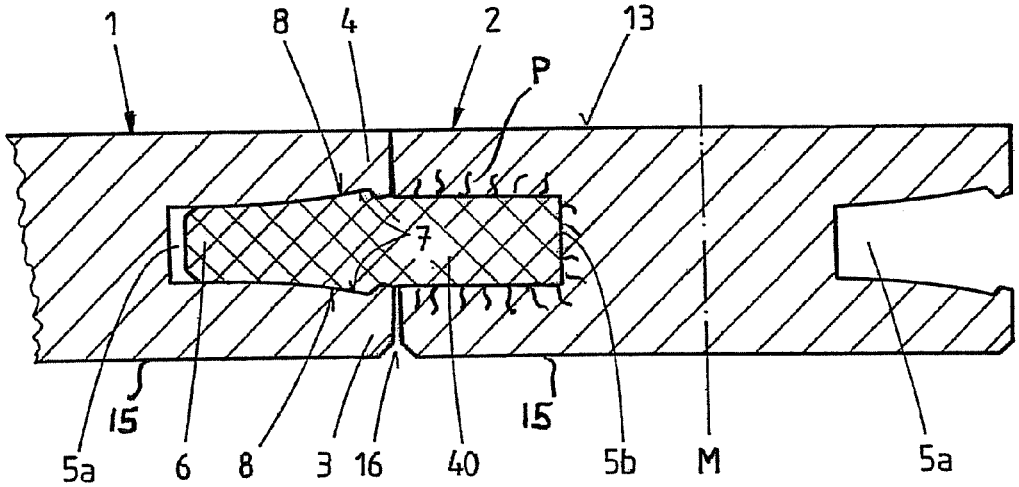
FIG. 4 shows an initial embodiment of two building elements connected to one another according to the invention.

FIG. 4 shows two building elements 1,2, for example, panels, connected to one another, wherein grooves 5*a* and 5*b* are formed in each of the building elements. The groove 5*b* in the right-hand building element 2 is firmly connected to the extrudate 40 processed to form the tongue 6, wherein the extrudate 40 completely fills the groove 5*b*. In the exemplary embodiment shown in FIG. 4, the extrudate 40 is connected by form-fit fit connection to the interior of the groove 5*b* in the right-hand panel 2, for instance, by gluing or filling with the still-soft extrudate. In the exemplary embodiment, the free end 6 of the extrudate 40 has been processed by milling so that it creates a form-fit connection with the correspondingly formed groove 5*a* of the adjacent, left-hand panel 1. However, according to the invention, a force-fit, separable connection, not shown here, of the end of the extrudate forming the tongue 6 to the panel 1 can also be provided. The building elements 1,2 are disposed with their end faces in contact with one another in the region close to the useful surface (e.g. the floor surface), but they provide a gap 16 in the region close to the base.

FIG. 4 shows an embodiment of the invention in which each of the individual building elements 1,2 has been provided with grooves 5*a* and 5*b* on both of its opposing end faces or on all four of its end faces. The building elements 1,2 are therefore designed in a symmetrical manner relative to their middle plane shown in the diagram as M.

Figure 5:
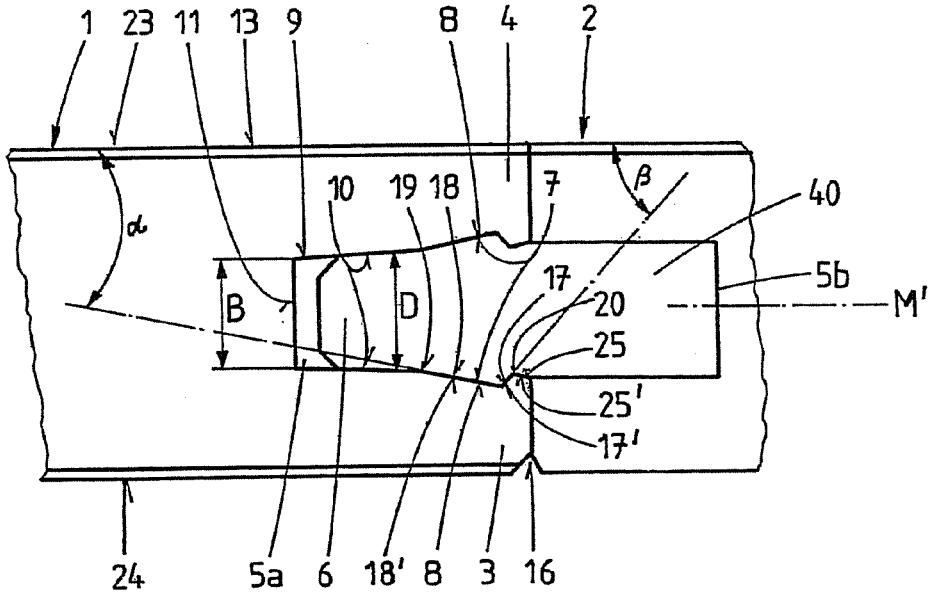
FIG. 5 shows a detail illustrating the profile of the tongue designed for snap-fastening.

The design of the grooves 5*a* and 5*b* and of the tongue 6 of the connecting means 40 is implemented in the same manner as described in the context of FIGS. 5 and 6 and the subsequent description. As shown in FIG. 4, the mutually-engaging projections 7 and indentations 8, which act as locking elements, are matched with one another and correspond, with reference to their cross-sectional form, to the projections 7 and indentations 8 shown in FIGS. 5 and 6. However, in principle, it is also possible to select other, similar cross-sectional forms for the locking elements 7,8 and/or to provide different angles of inclination for the tongue and groove surfaces relative to the surface 13 of the building elements 1,2 shown here. The essential feature is the resilience of the arms 3,4, in order to ensure the interlocking of the locking elements 7,8, in other words to guarantee the desired snap-fastening.

If necessary or desirable for technical reasons, the locking elements 7,8 can also interlock, if the arms 3,4 of the left-hand panel 1 are not designed to be resilient. For example, the groove 5*a* of the left-hand panel 1 may also be made from extrudate or similar, like the tongue 6; this could be achieved by filling and/or foaming of a groove with an appropriate, preferably resilient material and subsequently milling the groove geometry into the material introduced into the original groove 5*a*. In this case, it is not necessary for the arms 3,4 of the panel, that is, of the core material, to give in a resilient manner. In this context, the connection itself has a better appearance, and contamination and water can penetrate less easily into the connection.

It is also conceivable for the free end, i.e., the tongue 6 made from the extrudate 40 to be provided with a gap, in such a manner that the upper side and the lower side of the tongue 6 can be pushed together by pressure from the outside, so that a snap-fastening can be achieved with the groove 5*a;* in other words, the locking means 7 and 8 are engaged with one another.

The relatively wide building elements 1,2, which are, however, shown in FIG. 4 with a compressed width, provide dovetail grooves 5*a* on one of their opposing end faces, but especially on two end faces disposed at right angles to one another.

FIGS. 5 and 6 serve to illustrate the profile of the tongue 6. They should be understood as a detail from FIG. 4; only the free end of the tongue 6 is shown in FIG. 6.

As can be seen in FIG. 5, the building elements 1,2 consisting especially of wooden or synthetic material, can be provided with coatings 23, 24, in order to achieve appropriate surface qualities and/or an appropriate appearance.

Mutually matching locking elements 7,8 are provided on the tongue 6 and/or the tongue surfaces 10 and in the groove 5*a* and/or on the groove surfaces and/or the lateral surfaces 9 of the groove 5*a*. These locking elements are formed by projections 7 and indentations 8, which co-operate with one another or can be snap-fastened together. The cross-sectional forms of the indentations 8 and the associated projections 7 correspond to one another, so that the locking elements enter into close contact with one another, that is to say, they form a form-fit snap-fastening.

In the connected condition of the building elements 1,2, the locking elements 7,8 are engaged with one another. In particular, the locking elements 7,8 are designed along the entire length of the longitudinal and/or narrow sides of the building elements 1,2.

In FIG. 6, a projection 7 is provided only on the lower tongue surface 10; this is accommodated in an indentation 8 in the groove surface 9 which is in contact with this tongue surface 10. When the tongue 6 is introduced into the groove 5, the two arms 3,4 of the groove 5 are pressed apart in a resilient manner; when the tongue 6 is withdrawn from the groove 5, a resilient spreading of the arms 3,4 of the groove takes place.

In the case of the embodiment of the invention shown in FIG. 6, a projection 7 is formed only on one side of the tongue 6. The projection 7 is designed in such a manner that the tongue surface 10 runs level from the front, free end-region of the tongue 6 up to a kink, which is disposed at the thickest position of the tongue and continues into a rear, short surface 17, which in its turn continues into a surface 31 leading to the building element 2. Only a partial region 30 of the tongue surface 10 is accommodated in the indentation 8 in the groove surface 9; this partial region of the tongue surface, however, is disposed in close contact with the surface 18' of the indentation; also, the rear, shorter surface 17 is in close contact with the surface 17' of the indentation 8 disposed towards the opening of the groove.

The tongue surface 10 and/or its partial region 30 is inclined at an angle a to the surface 13 of the two building elements 1,2; the rear, shorter surface portion 17 is inclined at an angle b to the surface 13 of the two building elements 1,2. The same applies for the two surfaces 17' and 18' of the indentation 8 in the arm 3 of the groove. The region of the groove surface 9 disposed outside the indentation 8 of the groove arm 3 and/or the region of the groove surface 9 close to the base of the groove, is inclined at an angle g to the surface 13 of the two building elements. The surface 10 of the tongue 6, which does not provide a projection and which is in close contact with the facing groove surface 9, is inclined at the same angle g.

In order to achieve a defined mutual position of the connected building elements 1,2, it may be expedient, if the angle $\alpha$ relative to the useful surface and/or upper surface 13 of the longer side 18 of the triangle of the projection 7 on the tongue 6 corresponds to the angle and/or the inclination, especially of the front region, of the tongue surface 10, which runs, in its front region, at a distance from the groove surface 9. The majority of the length of the tongue surface 10 which is free from locking elements is in contact with the inner surface 9 of the groove, and both surfaces approach the upper surface or useful surface 13 of the two building elements 1,2 at the angle $\gamma$, viewed from the base of the groove 11.

In practice, it is advantageous if the indentation and/or the groove are provided in the groove surfaces and tongue surfaces which are closer to the upper surface. It is particularly advantageous, if corresponding locking elements are provided in both tongue surfaces and both groove surfaces. The connection is then formed in a self-centring manner, which simplifies assembly and is self-locking in the final position.

FIG. 6 shows that when the tongue 6 is inserted into the groove 5, the groove arms 3,4 are spread or pushed away from one another. In particular, the groove surface 25' close to the opening of the groove and the tongue surface 10, especially its region 30, slide over one another, so that the groove arms 3,4 are moved apart without damage. When the tongue 6 is removed from the groove 5, the groove arms 3,4 are widened as a result of the sliding of the surfaces 17 and 17' against one another.

FIG. 5 shows a particularly advantageous embodiment of the invention, wherein the groove 5 and the tongue 6 are advantageously designed to be symmetrical to a middle plane M' through the building elements 1,2 perpendicular to the plane of the drawing.

The cross-section of the projection 7 and/or of the indentation 8 according to FIG. 5 is triangular, wherein the sides 17, 17' disposed closer to the opening of the groove are shorter and more steeply inclined than the sides 18, 18' of triangle disposed closer to the base 11 of the groove. When the tongue 6 is introduced into the groove 5*a*, the longer side 18 of the projection 7 slides over the inner edge and/or over a chamfer 25' formed in this region of the arm 3 of the groove until the projection 7 has overcome this interior edge surface 25' and is then accommodated in the indentation 8. Accordingly, a locking of the building elements is achieved by snap-fastening.

In the case of the advantageous embodiment according to FIG. 5, especially symmetrically disposed projections 7 or indentations 8 are formed on the two opposing tongue surfaces 10, and indentations and projections are formed on the two contacting groove surfaces 9, matching these projections 7 and indentations 8 respectively, and/or the groove 5*a* and the tongue 6 are formed in a mutually matching dovetail design. This embodiment allows a double locking of the two building elements 1,2, wherein this kind of locking is also readily separable, by detaching and/or pulling apart the two building elements 1,2 from one another within the plane which they occupy. The widening of the arms 3,4 can be supported by twisting the building elements relative to one another.

In this embodiment, the longer side 18 of the triangle and/or the surface of the projection 7 formed by this side continues to the front region of the tongue surface 10 forming a kink 19; the region of the groove surface 9 close to the base of the groove and this front region of the tongue surface 10 are disposed, like the projection 7 and the indentation 8, in close contact with one another; in this manner, a very accurate connection of the building elements 1,2 can be achieved and, at the same time, it can be guaranteed that the end faces of the building elements 1,2 contact one another under pressure and/or are drawn together so that any gap between the building elements 1,2 at the useful surface 13, as well as any separation of the building elements 1,2 during their use, can be avoided.

The region of the groove surfaces 9 closer to the base of the groove and the region of the tongue surfaces 10 close to the free end of the tongue 6 provide the same angle of inclination $\gamma$. The angle $\alpha$, enclosed by the surfaces 18 of the projection and/or the surfaces 18' of the indentation relative to the surface 13 of the building elements 1,2, is greater than the angle $\gamma$. The region of the interior edge surface 25' is also inclined at this angle $\alpha$ relative to the surface 13 of the two building elements 1,2.

The angle $\beta$, at which the shorter sides 17, 17' of the triangle are inclined, is greater than the angle $\alpha$ and advantageously encloses an angle between 25° and 65° relative to the surface 13 of the building elements 1,2.

With reference to the connection and separation of the building elements, it is advantageous if the sides 18, 18' of the triangle close to the base of the groove are approximately four-times to eight-times, preferably five-times to seven-times, as long as the sides 17, 17' of the triangle remote from the base of the groove, and if the angle between the two sides 17, 18 and/or 17', 18' of the triangle is 100° to 140°, and in particular, 110° to 130°.

To simplify insertion, it is advantageous if the internal end edges of the tongue 6 are provided with chamfers 12 and/or the internal end edge of the arm 4 of the groove without a snap-fastening and/or locking element are provided with a chamfer 29.

Using the method of connection according to the invention, it is possible and it is intended that the building elements 1,2 to be interconnected are disposed with the lower surfaces 15 in one plane.

In principle, several projections and/or indentations can be provided on one groove and/or tongue surface, which would further improve the self-locking of the connection in the final position.

FIG. 7 illustrates building elements 1,2, wherein, according to the invention, the extrudate 40,43 also extends as far as the surfaces 13. Mechanically and visually, it therefore provides a V-shaped joint 43,44 between the two end faces 42 of the building elements and along the edges of the building elements. The intermediate components 43,44 serve as a connecting means and also provides protection and decoration. The right-hand intermediate component is inserted in an inseparable manner in the groove 5*b,* and at the same time, forms the tongue 6, while the left-hand intermediate component is applied only to the edge 42 of the left-hand building element and only partially forms the groove 5*a,* and therefore acts only partially as a connecting means 17', 18.

Since the extrudate forms the end face of the building elements 1,2, this edge can be processed more accurately.

The production of a building element according to the invention will be described below with reference to the example of a floor covering. A wooden material, plywood/MDF/HDF or OSB board of standard format, for example, 1.040 mm×2.825 mm is coated with decorative paper on the upper side and counteracting paper on the other side using a short-cycle press or throughpress process. After coating, the large format is cut to the size required for the elements, for example, 195 mm×1.250 mm.

The elements obtained in this manner are now processed in milling machines to provide milled grooves in the longitudinal and transverse sides. Following this, the pre-milled elements are conveyed to an extrusion plant, where the extrudate is introduced into the milled grooves. The extrusion plant may also operate directly behind the milling machine, so that the extrudate is introduced into the form immediately behind the milling head.

In the final stage, the panels, processed according to the invention along the end faces of the longitudinal and transverse sides, are again conveyed to the milling machine for the formation of the required tongue and groove. As an alternative, this processing stage can also be implemented immediately behind the milling head and/or the extruder.

The extrudate can also be applied to normal end faces without a groove, thereby dispensing with one operational stage in this end-face region.

It is particularly economical if all of the end faces are initially provided with a groove, which is suitable for engagement with the tongue. Only one machine tool is required for this process, and it is not possible for a wrong side to be processed. The grooves, which are subsequently to be provided with tongues, are now filled with the extrudate. Following this, the extrudate is processed to form the tongues.

The invention is not restricted to connecting means in the form of tongues and grooves. On the contrary, the tongue and groove connection serves merely as an example for a type of connection, which may optionally be realised as a force-fit or form-fit connection.

What is claimed is:

1. An arrangement of building elements having a flat surface comprising:

a) a plurality of building elements capable of separable connection to one another using a tongue, a first groove, and a connecting means;

b) wherein the tongue comprises a different material than the building elements;

c) wherein the tongue is inseparably connected to the connecting means; and d) wherein the tongue via the connecting means is inseparably connected to a first one of the building elements by a form-fit connection and the tongue is connected in a separable manner to a second one of the building elements, said connecting means contacts a second groove of the first one of the building elements and penetrates and hardens in openings and pores in the second groove in the first one of the building elements.

2. The arrangement according to claim 1, wherein the first groove (5) and tongue (6) are provided for connecting the building elements to one another.

3. The arrangement according to claim 1, wherein the first one of the building elements (2) provides a second groove (5*b*) with or without undercutting, into which the connecting means (40) is introduced in an inseparable manner.

4. The arrangement according to claim 1, wherein the connecting means is manufactured from an extrudate.

5. The arrangement according to claim 1, wherein the connecting means is connected to the first one of the building elements by foam-filling.

6. The arrangement according to claim 1, wherein the connecting means fills the second groove (5*b*) of the first one of the building element by foam-filling.

7. The arrangement according to claim 1, wherein the tongue is formed by milling, after being inseparably connected through the connecting means to the first one of the building elements.

8. The arrangement according to claim 3, wherein the connecting means consists substantially of synthetic material and/or comprises wood obtained from the manufacture of the groove (5).

9. The arrangement according to claim 1, wherein the connecting means consists substantially of a combination of synthetic material and wood.

10. The arrangement according to claim 1, wherein the connecting means consists substantially of a combination of wood and starch-containing products.

11. The arrangement according to claim 1, wherein the connecting means consists substantially of a combination of wood, starch-containing products and hydrophobing agents.

12. The arrangement according to claim 1, wherein the connecting means consists substantially of a combination of wood, starch-containing products, hydrophobing agents and natural or synthetic binding agents.

13. The arrangement according to claim 1, wherein the connecting means consists substantially of a combination of wood and organic, synthetic binding agents.

14. The arrangement according to claim 1, wherein the building elements are connected in a separable manner by the connecting means (40) using form-fit connection.

15. The arrangement according to claim 1, wherein the first groove is defined by two arms (3, 4) designed to be resilient and that the tongue can be inserted into the first groove.

16. The arrangement according to claim 15, wherein especially in order to achieve a strong but separable connection of the building elements (1, 2):

a) the first groove (5) is formed directly in the second one of the building element (1);

b) the width (B) of the first groove (5) increases from the inside to the outside;

c) the thickness (D) of the tongue (6) decreases towards its free end;

d) the tongue (6) having a front surface (18, 30) enclosing an angle (α) relative to the large flat surface (13) of the building elements (1, 2) and having a shorter rear surface (17) adjoining the latter surface and enclosing an angle (β), which exceeds the angle (α) relative to the large flat surface (13) of the building elements (1, 2) thereby forming a kink;

e) the groove (5) provides a contact surface (18') close to the base of the groove, which, in the locked position, is at least partially in contact with the front surface (18, 30), and a shorter rear surface (17'), remote from the base of the groove, which, in the locked position, is in contact with the shorter rear surface of the tongue (17); and f) at least one of the arms (3) of groove (5) being bendable outwards in a resilient manner relative to the other arm (3) of the groove (5) in each case, so that the tongue (6) is held in the resting position by the arms (3) of the groove (5) subject to a clamping effect.

17. The arrangement according to claim 16 wherein the angle of the tongue front surface (α) enclosed relative to the large flat surface (13) of the building elements (1, 2) is greater than an angle (γ), enclosed by a region (9) on the first groove close to the base of the groove relative to the large flat surface (13) of the building elements (1, 2).

18. The arrangement according to claim 15, wherein the groove arm (4) of the one building elements (1) close to the surface is in contact a region provided close to the surface of the other building element (2).

19. The arrangement according to claim 15, wherein the arms (3, 4) of one groove are designed to be of equal length.

20. The arrangement according to claim 1, said connecting means (40) having a maximum thickness (D) and wherein the maximum thickness (D) of the connecting means (40) is less than the thickness of the building elements perpendicular to the flat surface.

21. The arrangement according to claim 20, said connecting means (40) and tongue (6) having a maximum thickness (D), wherein the maximum thickness (D) of the connecting means (40) is the same as the maximum thickness (D) of the tongue (6).

22. The arrangement according to claim 1, wherein the connecting means (40) are designed in such a manner that the end faces of two adjacent building elements (1, 2), can, at least partially, butt against one another, especially in the region of the upper surface.

23. The arrangement according to claim 1, wherein the building elements provide a flat under-surface (15) to be supported on a level base.

24. The arrangement according to claim 1, wherein the building elements are panel-shaped or strip-shaped.

25. The arrangement according to claim 1, wherein the building elements are coated on the upper and/or lower side with synthetic-material laminates.

26. The arrangement according to claim 1, wherein the building elements are selected from the group comprising wooden materials.

27. The arrangement according to claim 1, wherein in the case of two interconnected end faces of two adjacent building elements (1, 2), one end face provides a first groove (5a) formed by two arms (3, 4) of the same length.

28. The arrangement according to claim 1, wherein the tongue (6) can be connected to the first groove (5*a*) in a separable manner.

29. The arrangement according to claim 1, wherein the connecting means inseparably connected to the first one of the building elements consists of a water-resistant material.

30. The arrangement according to claim 1, wherein the connecting means provides greater strength than the material of the building elements.

31. The arrangement according to claim 1, wherein the building elements can be interconnected by the connecting means with a snap-fastening.

32. The arrangement according to claim 1, wherein mutually matching locking elements (7, 8), in the form of an indentation (8) and a projection (7), are provided on at least one side of the first groove (5) and on at least one side of the tongue (6), preferably extending over the entire length of the first groove and the tongue in order to achieve a strong but separable connection between the building elements and also in order to hold the connected building elements (1, 2) in the connected position.

33. The arrangement according to claim 32, wherein the projection (7) is disposed in the first groove (5) and/or in the region between arms (3, 4) adjacent the first groove (5).

34. The arrangement according to claim 32, wherein the angles (α), at which the sides (18, 18') of the projection (7) close to the base of the groove and of the indentation (8) are inclined, are of the same magnitude.

35. The arrangement according to claim 1, wherein the tongue is designed to be solid.

36. The arrangement according to claim 1, wherein the first groove (5) and the tongue (6) are formed in a middle region of the relevant end faces of the building elements (1, 2).

37. The arrangement according to claim 1, wherein the arrangement comprises building elements (1) which provide the first groove (5) on one of their end faces and a tongue (6) on the other end face in each case, and also comprises building elements (1) which provide first grooves (5) and/or tongues (6) on both opposing end faces or on all end faces, and/or that the building elements (1, 2) are designed symmetrically and/or in an identical manner with reference to a plane perpendicular to their surface and extending through the longitudinal and/or transverse middle axis.

38. The arrangement according to claim 1, wherein each building element has lateral edges and an upper surface one or more of the lateral edges of at least one building element being provided in an inseparable manner with extrudate extending up to the upper surface of the building element which is visible.

39. An arrangement of building elements having a flat surface comprising:

a) a plurality of building elements capable of separable connection to one another using a tongue, a first groove, and connection means;

b) wherein the tongue comprises a different material than the building elements;

c) wherein the first groove is defined by two arms designed to be resilient and that the tongue can be inserted into the first groove i) the first groove is formed directly in a second one of the building elements;

ii) the width of the first groove increases from an inside to an outside;

iii) a thickness of the tongue decreases towards a free end iv) the tongue having a front surface enclosing a first angle relative to a large flat surface of the building elements and having a shorter rear surface adjoining a latter surface and enclosing a second angle, which exceeds the first angle relative to the large flat surface of the building elements, thereby forming a kink;

v) the first groove provides a contact surface close to a base of the first groove, which, in a locked position, is at least partially in contact with the front surface, and the shorter rear surface, remote from the base of the first groove, which in the locked position, is in contact with the shorter rear surface of the tongue; and vi) at least one of the arms of the first groove being bendable outwards in a resilient manner relative to the second arm of the first groove in each case, so the tongue is held in a resting position by the arms of the first groove subject to a clamping effect;

d) wherein the tongue is inseparably connected to the connecting means; and e) wherein the tongue via the connecting means is inseparably connected to a first one of the building elements by a form-fit connection and the tongue is connected in a separable manner to the second one of the building elements, said connecting means contacts a second groove of the first one of the building elements and penetrates and hardens in openings and pores in the second groove in the first one of the building elements wherein the angle of the tongue front surface enclosed relative to the large flat surface of the building elements is greater than an angle enclosed by a region on the first groove close to the base of the groove relative to the large flat surface of the building elements.

40. The arrangement according to claim 39 wherein in forming a projection (7) only on one side of the tongue (6) and an indentation (8) only on the side of the first groove (5) facing towards the latter side, the surfaces of the tongue (6) and first groove (5) without projections or indentations are in tight and close contact with one another and enclose the same angle (γ) relative to the large flat surface (13) of the building elements (1, 2).

41. The arrangement according to claim 40, wherein in the connected condition of the building elements (1, 2), the tongue surface (10) disposed in front of the projection (7) towards the front end of the tongue is in contact with a surface (9) of the groove.

42. The arrangement according to claim 41, wherein the side of a triangle forming the indentation (8) is disposed in the plane of the groove surface (9), wherein a side (17') of the triangle, which is closer to the opening of the groove, is shorter and more steeply inclined at an angle (β) relative to the large flat surface (13) than a side (18') of the triangle, which is disposed closer to the base (11) of the groove and inclined at an angle (α) relative to the large flat surface (13), that the longest side of the triangle of the projection (7) is disposed in the plane of the tongue surface (10), wherein the side of the triangle (17) disposed remote from the distal end of the tongue is shorter and is more steeply inclined at an angle (β) relative to the surface (13) than a side (18) of the triangle close to the distal end of the tongue and inclined at an angle (α) relative to the surface (13), and that the projection (7) formed on the tongue (6) provides a cross section corresponding to the triangular form of the indentation (8).

43. The arrangement according to claim 42, wherein a surface region (25') of the groove surface (9) between the groove opening and the shorter side (17') of the triangle of the indentation (8) encloses an angle relative to the surface (13) of the building elements (1, 2) which corresponds to the angle (α) of the longer side (18') of the triangle, wherein this surface region (25') of the groove (5) is designed as a sliding surface for the longer side (18) of the triangle of the projection (7) provided on the tongue (6).

44. The arrangement according to claim 43, wherein the region close to the distal end of the tongue and also the region close to the proximal end continues in each case into a side of the triangle of the projection (7), in each case forming a kink (19, 20).

45. The arrangement according to claim 42, wherein the side of the triangle (18) disposed close to the base of the groove is approximately four-times to eight-times as long as the side (17) of the triangle remote from the base of the groove, and that the angle between the two sides of the triangle (17, 18) is 100° to 140°.

46. The arrangement according to claim 42, wherein the sides of the triangle of the projection (7) or of the indentation (8) continue into the front and/or rear region of the groove surface (9) and tongue surface (10) respectively, thereby forming a kink (19, 20).

47. The arrangement according to claim 42, wherein the angles (β) at which the sides (17, 17') of the projection (7) remote from the base of the first groove and of the indentation (8) are inclined, are of the same magnitude.

48. The arrangement according to claim 39, wherein:

a) the first groove has surfaces (9) and the tongue has surfaces (10) provided with the same angle of inclination (γ) relative to the large flat surface (13) of the building elements (1, 2), regions of the tongue surfaces (10) and the first groove surfaces being in contact in the connected condition of the building elements (1, 2);

b) an indentation (8) with a triangular form in a cross section perpendicular to the direction in which the building elements are joined, is provided as a locking element along the course of at least one groove surface;

c) a projection (7) with a triangular form in a cross section perpendicular to the direction in which the building elements (1, 2) are joined is provided along the course of at least one tongue surface; and d) in the connected condition of the building elements (1, 2), the projection (7) and the indentation (8) are in contact with one another along their contours in a tight, close and play-free manner.

49. The arrangement according to claim 48, wherein the triangular projection (7) on the tongue (6) is disposed between said regions on the surface of the tongue (6) which provide the same angle of inclination (γ) relative to the surface (13) of the building elements (1, 2).

* * * * *

UNITED STATES PATENT AND TRADEMARK OFFICE

CERTIFICATE OF CORRECTION

PATENT NO. : 7,377,081 B2
APPLICATION NO. : 10/446456
DATED : May 27, 2008
INVENTOR(S) : Ruhdorfer It is certified that error appears in the above-identified patent and that said Letters Patent is hereby corrected as shown below:

Column 18, Line 28, Claim 18, "contact a" should read -- contact with a --

Signed and Sealed this

Eighteenth Day of November, 2008

JON W. DUDAS
*Director of the United States Patent and Trademark Office*